US006081234A

United States Patent [19]

Huang et al.

[11] Patent Number: 6,081,234

[45] **Date of Patent: *Jun. 27, 2000**

[54] BEAM SCANNING REFLECTARRAY ANTENNA WITH CIRCULAR POLARIZATION

[75] Inventors: John Huang, Arcadia; Ronald J. Pogorzelski, Santa Barbara, both of Calif.

[73] Assignee: California Institute of Technology, Pasadena, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 08/891,631

[22] Filed: Jul. 11, 1997

Related U.S. Application Data

[60] Provisional application No. 60/022,743, Jul. 24, 1996.

[51] Int. Cl.[7] ..... H01Q 19/06

[52] U.S. Cl. ..... 343/700 MS; 343/754; 343/757; 343/821

[58] Field of Search ..... 343/700 MS, 757, 343/758, 759, 761, 763, 766, 895, 909

[56] References Cited

U.S. PATENT DOCUMENTS

| | | | |
|---|---|---|---|
| 2,977,594 | 3/1961 | Marston et al. | 343/756 |
| 3,906,514 | 9/1975 | Phelan | 343/895 |
| 3,925,784 | 12/1975 | Phelan | 343/754 |
| 4,115,776 | 9/1978 | Roeder et al. | 343/118 |
| 4,656,484 | 4/1987 | Brown et al. | 343/761 |
| 4,684,952 | 8/1987 | Munson et al. | 343/700 |
| 4,804,899 | 2/1989 | Wurdack | 343/757 |
| 5,283,590 | 2/1994 | Wong | 343/757 |

OTHER PUBLICATIONS

Huang and Pogorzelski, Microstrip Reflectarray with Elements Having Variable Rotation Angles, *Jet Propulsion Laboratory*, Preprint, pp. 23–26.

Huan and Pogorzelski, Microstrip Reflectarray with Elements Having Variable Rotation Angles, *Jet Propulsion Laboratory*, Preprint, pp. 1–22.

H. Richard Phelan, Spiraphase—a New, Low Cost, Lightweight Phased Array, *Microwave Journal International Edition*, pp. 41–44, Dec. 1976.

H. Richard Phelan, Spiraphase reflectarray—for Multitarget Radar, *Microwave Journal International Edition*, 20(7):67, Jul. 1977.

Raab and Sikora, A Unique New Antenna technology for Small (and Large) Satellites, *Malibu research Associates*, Preprint, pp. 1–7.

*Primary Examiner*—Don Wong
*Assistant Examiner*—James Clinger
*Attorney, Agent, or Firm*—Fish & Richardson P.C.

[57] ABSTRACT

A novel means of scanning a circularly polarized reflectarray antenna. The reflectarray is an array of metallic elements arranged on a surface designed to compensate for the various path lengths of the optical rays from an illuminating feed to the reflecting surface and then to the antenna aperture. With appropriate design, the phase in the aperture can be made to vary linearly in any desired direction and also to produce a radiated beam normal to the constant phase surface. In the case of circular polarization, this path length compensation can be accomplished by rotation of the individual elements.

24 Claims, 5 Drawing Sheets

BEAM SCANNING REFLECTARRAY ANTENNA WITH CIRCULAR POLARIZATION

CROSS-REFERENCE TO RELATED APPLICATIONS

This application claims priority from U.S. Provisional Application Ser. No. 60/022,743 filed Jul. 24, 1996.

STATEMENT AS TO FEDERALLY SPONSORED RESEARCH

The invention described herein was made in the performance of work under a NASA contract, and is subject to the provisions of Public Law 96-517 (35 U.S.C. 202) in which the Contractor has elected to retain title.

FIELD OF THE INVENTION

This invention relates to a scannable antenna using reflecting elements.

BACKGROUND OF THE INVENTION

This application describes reflecting array antennas or reflectarrays. Previous attempts at developing reflectarrays met with certain difficulties. For example, an X-band 0.75 meter diameter microstrip reflectarray using variable length phase delay lines was developed. This reflectarray demonstrated a relatively high efficiency (70%) with a peak gain of 35 dB for linearly polarized radiation. A 27 GHz microstrip reflectarray using variable-size patches was also attempted. This reflectarray had a diameter of 0.23 meters and achieved a gain of 31 dB with a relatively low efficiency of 31%, again for linearly polarized radiation.

The low efficiency of this latter array may have been in part due to efficiency-susceptibility to fabrication tolerance of patch dimensions at the high millimeter wave frequency. Another reason may be that phase is achieved in this system at the expense of amplitude. Only one correct dimension will resonate at a particular frequency and, by varying the patch sizes, the amplitude of many patch elements are sacrificed.

SUMMARY OF THE INVENTION

In one aspect, the invention is directed to an antenna having a plurality of reflecting elements, at least some of which are capable of rotation. A plurality of actuators are coupled to respective reflecting elements to individually control the amount of rotation of at least some of the reflecting elements. In one embodiment, the antenna also includes a controller to command the plurality of actuators in response to an input.

Implementations of the invention may include one or more of the following. The plurality of reflecting elements may be structured and arranged on a flat plane, may be metallic, and may be microstrips or crossed resonant dipoles. A plurality of transmission lines may be connected to the plurality of reflecting elements. The actuators may be micromachined motors or mechanical microactuators. The antenna may further include a source of electromagnetic radiation directed towards the plurality of reflecting elements which may further include a circularly polarized horn.

In another aspect, the invention is directed to a method for controlling electromagnetic radiation. The method includes the step of locating a plurality of reflecting elements in an optical path of the electromagnetic radiation. o0 A determination is made as to which of the reflectors need to rotate in order to produce a specified effect. A plurality of actuators is associated with the reflectors for rotating at least some of the plurality of elements. These actuators are controlled in response to an input so as to individually is control the amount of rotation of at least some reflecting elements.

Implementations of the method may include one or more of the following. The plurality of reflecting elements may be disposed in a plane, and the controlling electromagnetic radiation may include causing the electromagnetic radiation to be reflected in a predetermined direction, such as to scan the beam (in the case where the reflecting elements are continuously rotated) or to produce a beam normal to the plane of the reflecting elements. The electromagnetic radiation may be circularly polarized, and the controlling may include causing the electromagnetic radiation to be reflected in a predetermined direction relative to the plurality of reflecting elements.

In a further aspect, the invention is directed to a scannable beam. The beam includes a source of light and a plurality of reflecting elements at least partially in the path of the light, some of which include a rotatable mounting. A plurality of actuators is coupled to respective reflecting elements to individually control an amount of rotation of the reflecting elements. A controller commands the plurality of actuators in response to an input.

In a related implementation, the source of light may be a circularly polarized beam, and the reflecting elements may be continuously rotated to provide a scanned beam of light.

In general, the actuators may be coupled to respective reflecting elements to individually control the amount of rotation so as to compensate for differing path lengths between the beam and the plurality of reflecting elements to result in a reflected beam having a predetermined direction relative to the plane. The compensation may be by adjusting for phase shift or by adjusting for time delay. The predetermined direction may be normal to the plane.

In another aspect, the invention is directed to an antenna having a plurality of reflecting elements, at least some of the plurality of elements having transmission phase delay lines of variable length. A plurality of actuators are coupled to respective reflecting elements to individually control the length of the transmission phase delay lines of the reflecting elements. A controller commands the plurality of actuators in response to an input.

In a further aspect, the invention is directed to a method for controlling electromagnetic radiation. The method includes the step of locating a plurality of reflecting elements, at least some of the plurality of elements having variable length transmission phase delay lines, in an optical path of the electromagnetic radiation. A plurality of actuators is controlled in response to an input, the plurality of actuators coupled to the variable length transmission phase delay lines, to individually control the length of the delay lines.

Features of the invention include one or more of the following. Control of the phase distribution in an aperture of a reflectarray antenna is obtained for circularly polarized radiation through rotation of a number of individual array elements which may be small and low-profile printed microstrip elements. With proper design of the reflecting surface, one aspect may be to eliminate the reversal of polarization sense on reflection.

Advantages of the invention include the following. Phase control can be used for steering the main beam of an antenna to wide angles without the aberrations associated with such scanning in the case of a paraboloidal reflector. Furthermore, a phase shift in the reflected wave can be induced by rotating the elements of the reflecting surface. A reflecting surface possessing such properties can be used to create a novel antenna based on the reflectarray principle which can be scanned over wide angles by mechanical rotation of the individual reflecting surface elements. The reflectarray has the advantage of graceful degradation with element failure. The reflectarray may use a space feed which is virtually lossless compared with the more common series and corporate array feeding arrangements. Because of the low mass of high frequency microstrip elements, the rotation of the elements may be implemented using micro-actuators. With the present invention, a beam scanning antenna is provided that does not require a high cost or high loss phase shifter, T/R module, or beamformer.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

FIG. 3A shows an element with zero phase shift. FIG. 3B shows an element rotated by ψ radians.

Like reference numbers and designations in the various drawings indicate like elements.

DETAILED DESCRIPTION

Phase Control of a Radiated Wave

Figure 1B:
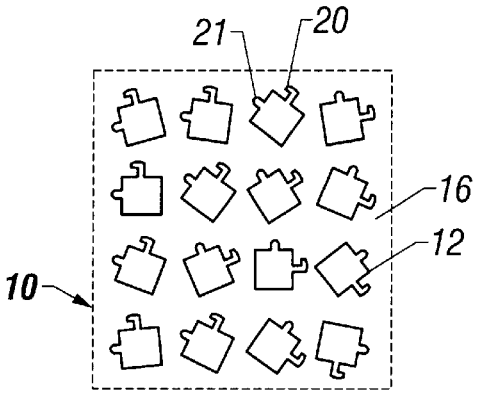
FIG. 1A shows a perspective schematic view of a reflectarray antenna according to an embodiment of the present invention, and FIG. 1B provides a close up top view of a portion of the antenna showing elements with variable rotation angles.

An infinite two-dimensional conventional array of radiating elements may be used to radiate electromagnetic waves having circular polarization. For simplicity, crossed resonant dipoles are considered which may be aligned with the axes of a Cartesian x,y system. Such devices are excited 90° out-of-phase with one another to radiate the circular polarization waves. However, any other element, such as a circularly-polarized horn or an eccentrically excited microstrip patch could be used as well. If the array elements are excited in-phase with each other, a beam is produced normal to the plane of the array; that is, in the z-direction. Assuming that the phasing is such as to produce left-hand circular polarization, the radiated field can be expressed in the form:

$$\vec{E}^{rad}=[(\hat{u}_x-i\hat{u}_y)\alpha e^{ikz}e^{-i\omega t}] \tag{1}$$

where α is the complex amplitude of the wave. If each of the elements is rotated by an angle as shown in FIG. 3 so as to align with the axes of a new coordinate system x', y' but retaining the same excitation, the displacements are:

$$\hat{u}_{x'}=\hat{u}_x \cos\psi+\hat{u}_y \sin\psi \tag{2a}$$

$$\hat{u}_{y'}=-\hat{u}_x \sin\psi+\hat{u}_y \cos\psi \tag{2b}$$

and the radiated field is:

$$\begin{aligned}\vec{E}^{rad} &= (\hat{u}_{x'} - i\hat{u}_{y'})\alpha e^{ikz}e^{-i\omega t} \\ &= [(\hat{u}_x\cos\psi + \hat{u}_y\sin\psi) - i(-\hat{u}_x\sin\psi + \hat{u}y\cos\psi)]\alpha e^{ikz}e^{-i\omega t} \\ &= (\hat{u}_x - i\hat{u}_y)\alpha e^{ikz}e^{-i\omega t}e^{i\psi}\end{aligned} \tag{3}$$

In other words, the element rotation has produced an equivalent phase advance (path shortening) of ψ radians. If the radiation had been right-hand circularly polarized, the result would have been a phase delay (path lengthening).

Using optical reasoning of the sort used in designing reflector antennas, the aperture phase can be varied as a function of position in the aperture by adjusting the individual array elements independently rather than together as in the above example. This provides a means of focusing the system and for scanning the beam and has, in fact, been demonstrated experimentally. Similar behavior in the "receiving" configuration is assured by reciprocity.

Phase Control of a Reflected Wave

If the horizontal and vertical dipoles of the crossed dipole elements of the above array are each connected to a transmission line terminated in a short circuit, the array becomes similar in behavior to a metallic reflecting surface. This surface may be illuminated by a normally incident left circularly polarized plane wave. For the present, only the so-called "antenna mode" scattering is considered. The "structural mode" scattering is considered below. In the antenna mode, the incident radiation is received by the elements, proceeds along the transmission line to the termination, is reflected by the short circuit, and returns via the line to the element where it is re-radiated into space. Thus, the phase of the reflected wave can be controlled by adjusting the length of the transmission line between the element and the termination. The adjustment need not be uniform throughout the array. Rather, one may control the aperture phase distribution just as in the active array case described above and thus scan the beam, for example.

In another case, the transmission lines connected to the horizontal and vertical dipoles may be of unequal lengths, $l_x$ and $l_y$, but these lengths may be uniform across the array. If the reflector is illuminated by a left circularly polarized normally incident plane wave propagating in the negative z-direction, the incident wave may be expressed as:

$$\vec{E}^{inc}=(\hat{u}_x+i\,\hat{u}_y)\alpha e^{-ikz}e^{-i\omega t} \tag{4}$$

The reflected wave may be written in the form:

$$\vec{E}^{refl}=(-\hat{u}_x e^{2ikl_x}-i\hat{u}_y e^{2ikl_y})\alpha e^{ikz}e^{-i\omega t} \tag{5}$$

where the negative signs arise from the reflection co-efficients of negative one at the short circuits. When $l_x=l_y$, the incident left circularly polarized plane wave propagates in the usual manner by virtue of the reversal of the direction of propagation. If $kl_x=\pi/2$ and $kl_y=0$, then the reflected wave will be:

$$\vec{E}^{refl}=(\hat{u}_x-i\hat{u}_y)\alpha e^{ikz}e^{-i\omega t} \tag{6}$$

which is left circularly polarized just as was the incident wave.

If the elements are rotated by angle ψ as in the "transmitting" case above, the excitation of each of the two orthogonal dipoles in each element can be determined by projecting the $\hat{u}_x$ and $\hat{u}_y$ field components onto the $\hat{u}_x$, and $\hat{u}_y$, axes at z=0. That is:

$$\tilde{E}^{inc}|_{z=0} = [(\hat{u}_{x'}\cos\psi + \hat{u}_{y'}\sin\psi) + i(\hat{u}_{x'}\sin\psi + \hat{u}_{y'}\cos\psi)]\alpha e^{-i\omega t} = (\hat{u}_{x'}e^{i\psi} + i\hat{u}_{y'}e^{i\psi})\alpha e^{-i\omega t} \quad (7)$$

The reflected wave now becomes:

$$\tilde{E}^{refl} = -(\hat{u}_{x'}e^{2kil_{x'}} + i\hat{u}_{y'}e^{2ikl_{y'}})\alpha e^{ikz}e^{-i\omega t}e^{i\psi} \quad (8)$$

where, again, the negative sign arises from the reflections at the transmission line short circuit terminations. Finally, re-expressing the reflected field in terms of the original x and y components yields:

$$\tilde{E}^{refl} = -[(\hat{u}_x\cos\psi + \hat{u}_y\sin\psi)e^{2ikl_{x'}} + i(-\hat{u}_x\sin\psi + \hat{u}_y\cos\psi)e^{2ikl_{y'}}]\alpha e^{ikz}e^{-i\omega t}e^{i\psi} \quad (9)$$

which, with some algebraic manipulation, can be written in the form:

$$\tilde{E}^{refl} = -\frac{1}{2}\left[\left(e^{2ikl_{x'}} - e^{2ikl_{y'}}\right)(\hat{u}_x - i\hat{u}_y)e^{2i\psi} + \left(e^{2ikl_{x'}} + e^{2ikl_{y'}}\right)(\hat{u}_x + i\hat{u}_y)\right]\alpha e^{ikz}e^{-i\omega t} \quad (10)$$

This reflected wave has both right and left circularly polarized components and the right circularly polarized component is independent of the rotation angle of the elements. If transmission line lengths are selected which differ by a quarter wavelength, for example, $kl_{x'}=\pi/2$ and $kl_{y'}=0$, then the right circularly polarized component of the reflected wave is eliminated and the remaining left circularly polarized component becomes:

$$\tilde{E}^{refl} = (\hat{u}_x - i\,\hat{u}_y)\alpha e^{ikz}e^{-i\omega t}e^{2i\psi} \quad (11)$$

Thus, the reflected wave has been delayed in phase (path lengthened) by 2ψ radians due to element rotation by angle ψ. A right circularly polarized incident wave would be phase advanced upon reflection. Had the transmission lines terminated in open circuits instead of short circuits, the reflected wave would be opposite in sign, but not opposite in sense, from that above. Such a sign change would also result from interchange of the two transmission lines.

The rotation need not be uniform across the aperture. Rather, the aperture phase may be adjusted as a function of position by independently rotating the elements.

The Flat Panel Reflectarray

Figure 1A:
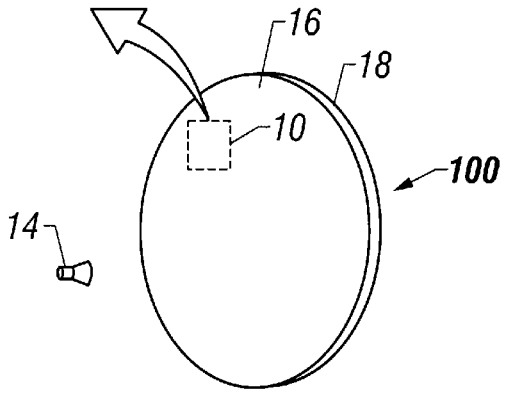

The above theory exposition is embodied in FIGS. 1A and 1B. A flat panel printed reflector 100 is provided having a plurality of sections 10 on which are located a plurality of circularly polarized elements 12. The elements 12 are illuminated from a focal point 17 (shown in FIG. 2) with a circularly polarized feed 14. The preferred embodiment locates these elements on a dielectric substrate 16 which is mounted on a ground plane 18. The elements 12 are designed to re-radiate the incident field with phases to form, for example, a planar phase front.

Figure 2:
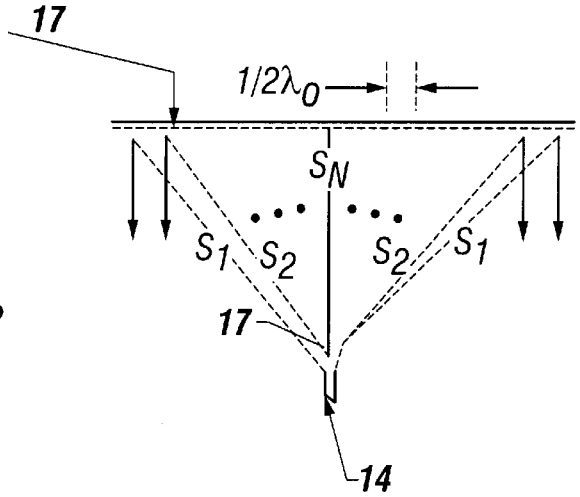
FIG. 2 shows a side view of the antenna of FIG. 1A.

FIG. 2 shows that the variation in path length of the various ray paths $S_1$ through $S_n$ from the feed 14 to the elements 12 may be compensated for by appropriate phase shifts introduced by variable length phase delay lines (first embodiment). The variation in path length of the various ray paths can also be compensated for by appropriate phase shifts introduced by rotating the elements 12 (second embodiment) of the reflecting array. For example, a constant phase across the aperture of the reflector 10 may result in a beam radiated normal to the reflector 10. In the second embodiment, the elements 12 may be differently rotated so as to produce a linear phase variation across the aperture resulting in a is scanned beam. The scan angle can be extremely large compared with that attainable from a parabolic reflector because the phase aberrations normally associated with wide angle scanning using a paraboloid can be compensated for by appropriate rotation of element 12.

If the illumination were linearly polarized, only one of the circularly polarized components is focused into a beam and the other is defocused. Finally, because the path lengths are compensated for by phase shift rather than time delay, the adjustments actually apply only at a single design frequency. However, bandwidths of up to about 10% are achievable with proper design.

Structural Mode Scattering

The antenna theory of this embodiment is based upon the so-called "antenna mode" scattering from the elements. This mode has an incident wave which excites a wave in the transmission lines 20 connected to the elements 12. This wave is reflected by the termination back to the element 12 which re-radiates the reflected wave. The so-called "structural mode" of scattering is one in which the incident wave induces currents on the antenna structure which in turn radiate.

The reflection from any mismatch between the element 12 and the transmission line 20 also contributes to this component.

The phase of this radiation is not directly controlled by transmission line length. Thus, there will be a component of the total field scattered by the reflecting surface which is not properly phased. However, if the gain of the antenna is sufficiently high, that is, if the aperture is sufficiently large, this "unphased" component will be negligible compared with the properly phased component precisely because it is unfocused.

Some evidence of the presence of this unfocused component is discernible as "null filling" in published experimental measurements of the radiated fields of reflectarrays.

First Embodiment

A circularly-polarized microstrip array for the $K_a$-band is designed to operate at a frequency of 32.0 GHz. The diameter of the array is a half-meter and the array contains 6,924 square elements. Each element in the first embodiment includes variable-length phase delay lines. The elements were etched on a Duroid substrate having a thickness of 0.25 mm and a relative dielectric constant of 2.2. With this substrate, the calculated single element bandwidth is about 4%. This antenna was designed for broadside radiation with the same f/D ratio of 0.75. Here "f" is the focal length and is the distance between the phase center of the feed horn 14 and the radiating plane of the elements 12. In this example, "f" is 37.2 cm. "D" is the diameter of the radiating aperture (half-meter).

Each element 12 has a square dimension of 2.946 mm. The spacing between elements 12 is 0.58 free-space-wavelengths which was determined to be optimal in avoiding grating lobes throughout the desired scan angle range. The elements are identical microstrip patch elements, but may also be variable-size printed dipoles, variable-size microstrip patches, variable-size circular rings, or other such elements.

The widths of the element transmission phase delay lines is 0.075 mm and has an impedance of 150 ohms. The input impedance of these square elements is measured to be about 230 ohms. Although not critical, the line impedance should be close to the input impedance so that mismatch and multiple reflections within the line are minimized. However, a line impedance of 230 ohms at the $K_a$-band frequency would yield an extremely thin line, and would present reliability and fabrication difficulties, e.g., it may be easily scratched or delaminated. In addition, it may be difficult to maintain the uniformity of line width across the large aperture if the lines are too thin. Thus, the 150 ohm line is used. The etching tolerance achieved across the aperture for the element and for the phase delay lines was 0.008 mm.

Figure 4A:
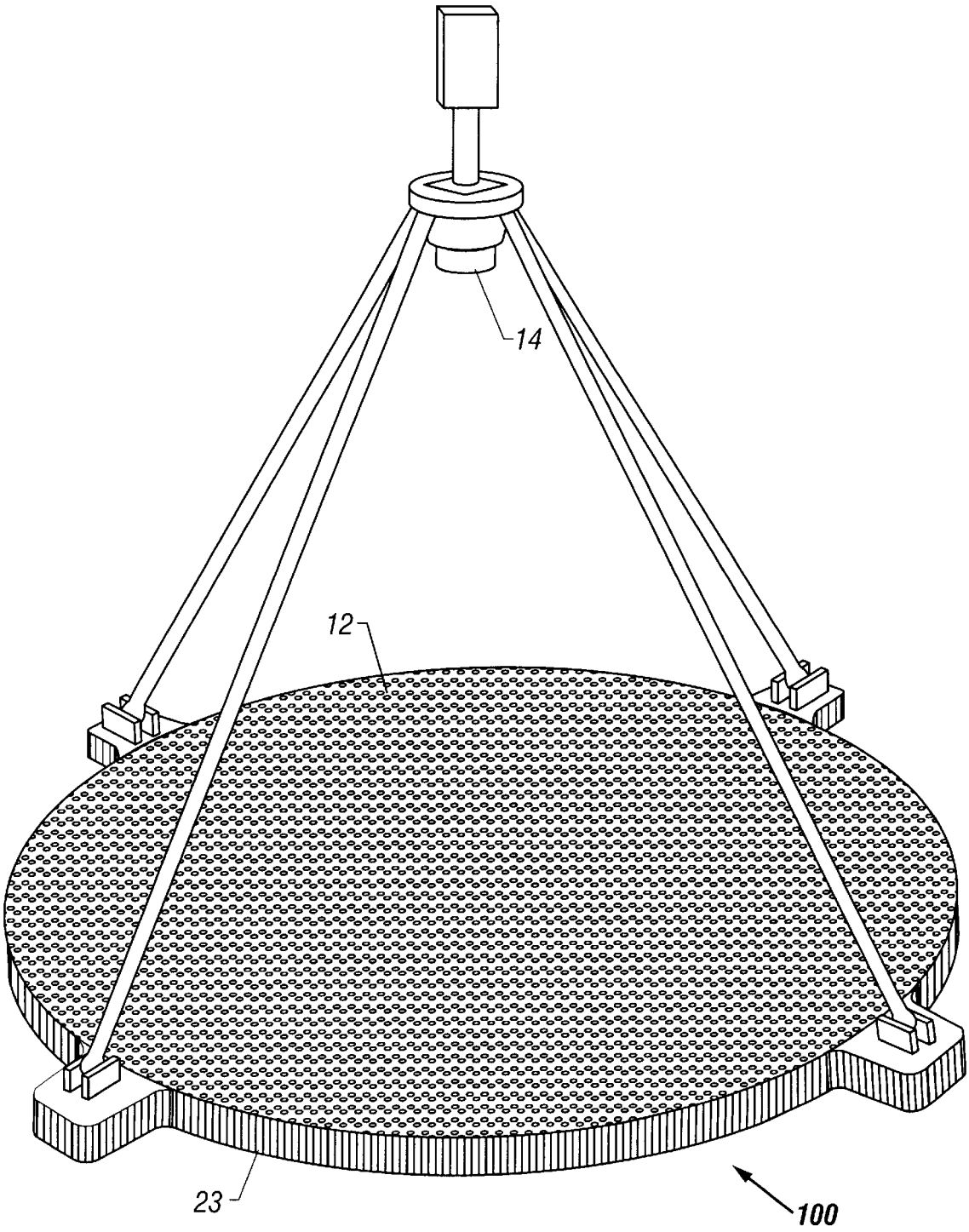
FIG. 4A shows a view of the reflectarray antenna.

To assure good antenna efficiency and a minimum of sidelobes, the radiating aperture of the reflectarray should maintain a surface figure tolerance of at least 1/30th of a wavelength, which here is 0.3 mm across a half-meter aperture antenna. To achieve this, the substrate is supported by a 1.9 cm thick aluminum honeycomb panel 23, as shown in the picture of FIG. 4. A 0.5 mm thick graphite epoxy face sheet is bonded to each side of the panel.

Figure 4B:
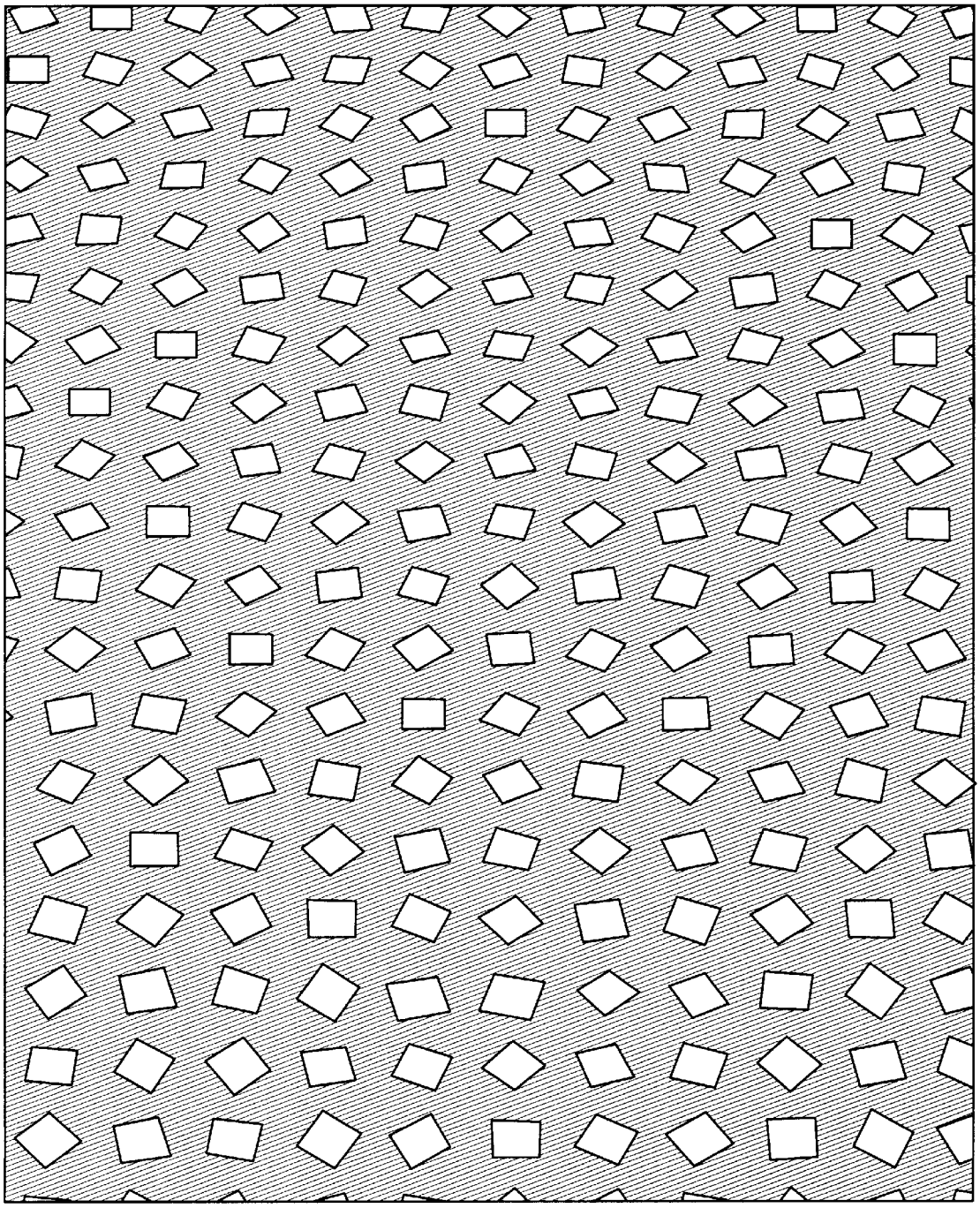
FIG. 4B shows a close-up view of the reflectarray antenna of FIG. 4A, detailing a number of the reflectarray elements.

An expanded view of the reflectarray elements is shown in FIG. 4B.

The feed horn 14 includes a corrugated circularly-polarized conical horn precision mounted above the honeycomb panel by four 1-cm diameter aluminum rods. The feed horn 14 illuminates the reflectarray with a −9 dB edge taper. The −3 dB and −9 dB beamwidths of the feed horn are 41° and 69°, respectively. The horn's corrugation reduces sidelobes for lower spillover loss and reduces the cross-polarization level for better polarization efficiency.

Figure 5:
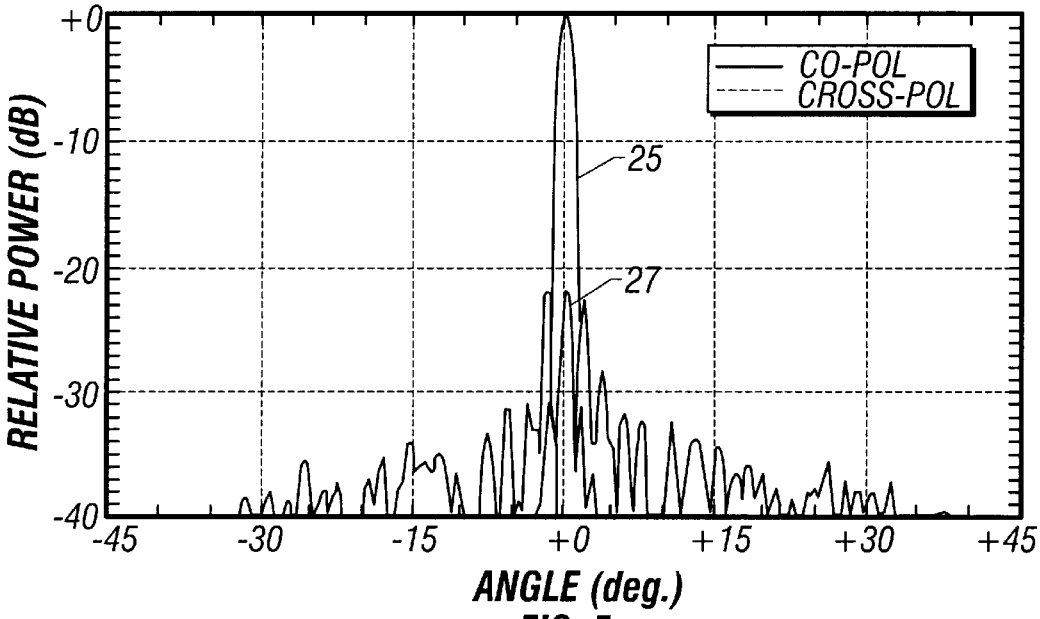
FIG. 5 shows a measured radiation pattern of a reflectarray according to a first embodiment of the present invention, having elements with variable-length phase delay lines.

The radiation pattern of the reflectarray of the first embodiment is shown in FIG. 5. This graph shows units of relative power radiated as the ordinate and angle from the normal as the abscissa. The graph of the intensity of the co-polarized component 25 shows a peak sidelobe level of −22 dB. All other sidelobes, after the first two, are below −30 dB. This indicates that the undesired backscattered fields (from elements, phase delay lines, ground plane edges, etc.) are insignificant compared to the desired re-radiated field. This, in turn, indicates that the elements are well-matched in impedance to the phase delay lines and thus that the fabrication accuracy is well-controlled. This measured pattern is similar in other azimuth planes of the antenna. The two high sidelobes adjacent the main beam are believed to be caused by the feed horn 14 blockage. The graph of the cross-polarization component 27 shows that its intensity is below −40 dB except in the immediate vicinity of the main beam. The relatively high cross-polarization in the main beam, of about −22 dB, is caused by the co-phasal behavior of the cross-polarized components of the elements and the cross-polarization of the feed horn 14. In other words, the cross-polarized components are all coherently directed to the same direction by the same set of phase delay lines.

Figure 7:
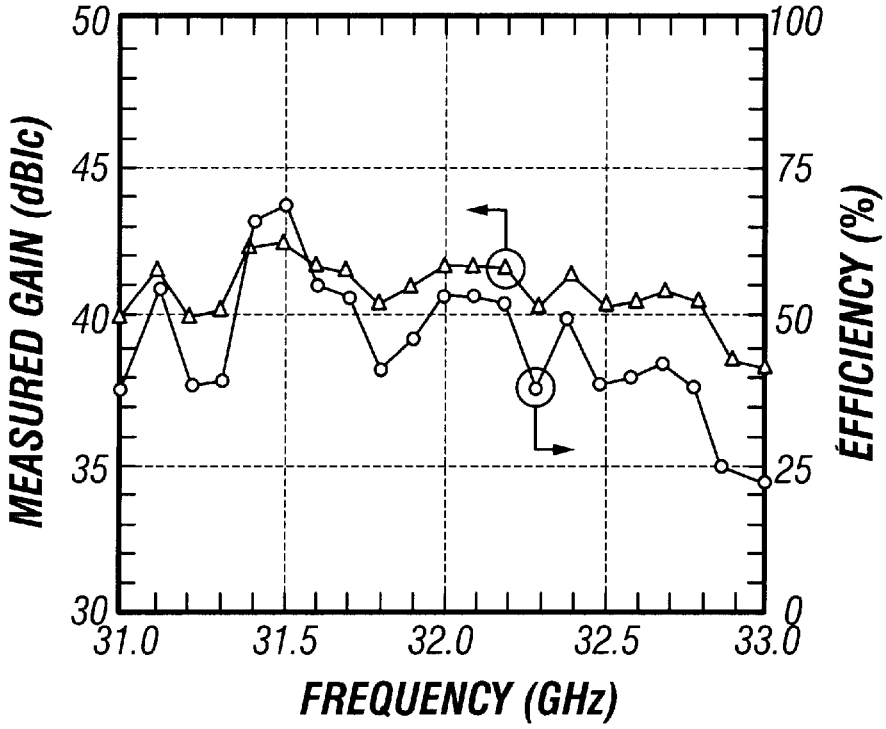
FIG. 7 shows measured bandwidth characteristics of a reflectarray according to the first embodiment, having elements with variable-length phase delay lines.

The bandwidth behavior is shown in FIG. 7, in which the measured gain, as well as the efficiency, are plotted against the frequency. The patterns and antenna gains are measured over the frequency range from 31.0 GHz to 33.0 GHz. Across this range, all of the patterns (except at very high frequencies where pattern degradation begins to occur) exhibit features similar to those of FIG. 5. At 32.0 GHz, the measured −3 dB beamwidth is 1.18° and the measured gain is 41.75 dB, corresponding to an overall antenna efficiency of 53%. At the peak, the reflectarray of this first embodiment shows a measured gain of 42.75 dB for an antenna aperture efficiency of 69% at the frequency of 31.5 GHz. From FIG. 7, one may also infer a +/−1 dB gain (around a nominal gain of 41.75 dB) bandwidth of 1.0 GHz which is about 3% and a −3 dB gain (from the peak gain of 42.75 dB) bandwidth of 1.8 GHz which is about 5.6%.

An oscillatory response may also be seen. One reason for this may be that, in addition to the resonance of is the elements 12, some of the delay lines also become resonant at various frequencies since their length dimensions vary and occasionally become similar to those of the elements. The delay line resonances may add in-and-out of phase with the element resonances over the bandwidth of interest, resulting in the oscillatory behavior. One way to avoid this oscillatory response is to place the phase delay lines behind the ground plane in an additional substrate layer. Another is to use the rotational technique as described below in connection with the second embodiment.

Second Embodiment

In this embodiment, the elements 12 are identical but employ variable rotation angles. FIG. 3 shows an element 12 having two transmission phase delay lines 20 and 21 having unequal lengths $l_x$ and $l_y$ respectively. However, these lengths, as well as the element size, are otherwise uniform across the reflectarray.

Figure 3A:
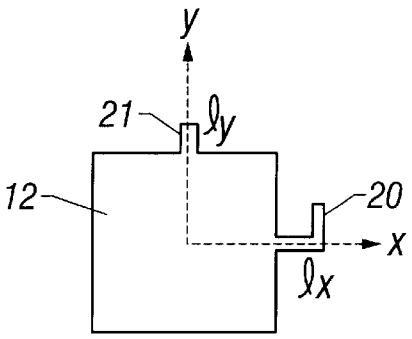
FIGS. 3A and 3B show schematic drawings of reflectarray elements.
Figure 3B:
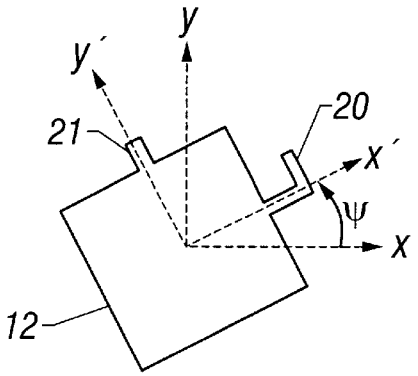

As noted above, if a left-hand circularly polarized wave is incident on the element of FIG. 3A, and if $l_x$ is longer than $l_y$ by 90° phase, the reflected wave remains left-hand circularly polarized. If a left-hand circularly polarized wave is incident on the element of FIG. 3B, the reflected wave has a phase of $2\psi$ radians longer than that reflected from the element of FIG. 3A. A right-hand circularly polarized wave would have a $2\psi$ radians phase advancement upon reflection.

The structure of the reflectarray of the second embodiment is partially similar to that of the first embodiment. The spacing between elements 12 of 0.58 free-space-wavelengths was also used to allow room for the rotation of the elements 12 so that neighboring elements did not physically interfere with each other. The elements 12 may be rotated by, for example, miniature or micro-machined motors placed under each microstrip element 12. The beam may be made to continuously scan across wide angles by continuous rotation using such motors. Scanning in this way avoids the insertion losses of, e.g., phase shifters in a conventional phased array.

Figure 6:
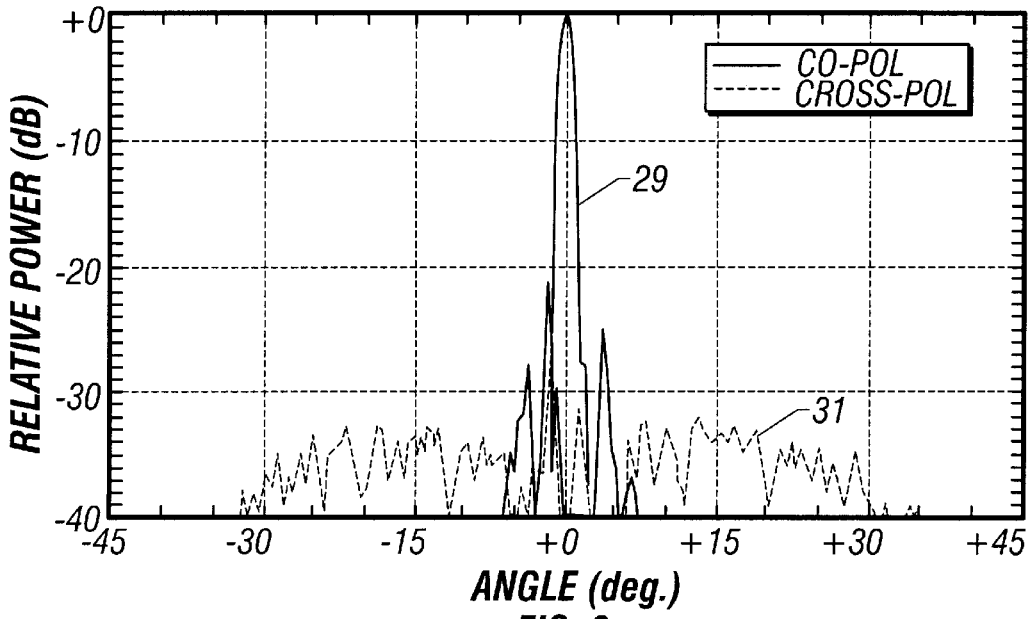
FIG. 6 shows a measured radiation pattern of a reflectarray according to a second embodiment of the present invention, having elements with variable rotation angles.

The radiation pattern of the reflectarray of the second embodiment is shown in FIG. 6. Again, the graph shows units of relative power radiated as the ordinate and angle from the normal as the abscissa. The graph of the intensity of the co-polarized component 29 again shows a peak sidelobe level of −22 dB due to the feed horn 14 blockage. All other sidelobes, after the first few, are below −40 dB, which is even lower than the lobes of the first embodiment. The graph of the cross-polarization component 31 shows that its intensity is below −30 dB except for one lobe at −28 dB. Thus, the single high cross-polarization component in the main beam of the first embodiment has been replaced with a distribution over a wide angular region. It is believed that the major reason for this is the diffuse, instead of co-phasal, scatterings by the nearly randomly rotated elements and transmission delay lines. That is, the rotations of the elements have, electrically, a unique pattern for the co-polarized component field. However, the rotations of the elements have a random pattern for the structurally scattered fields and the cross-polarized fields.

Figure 8:
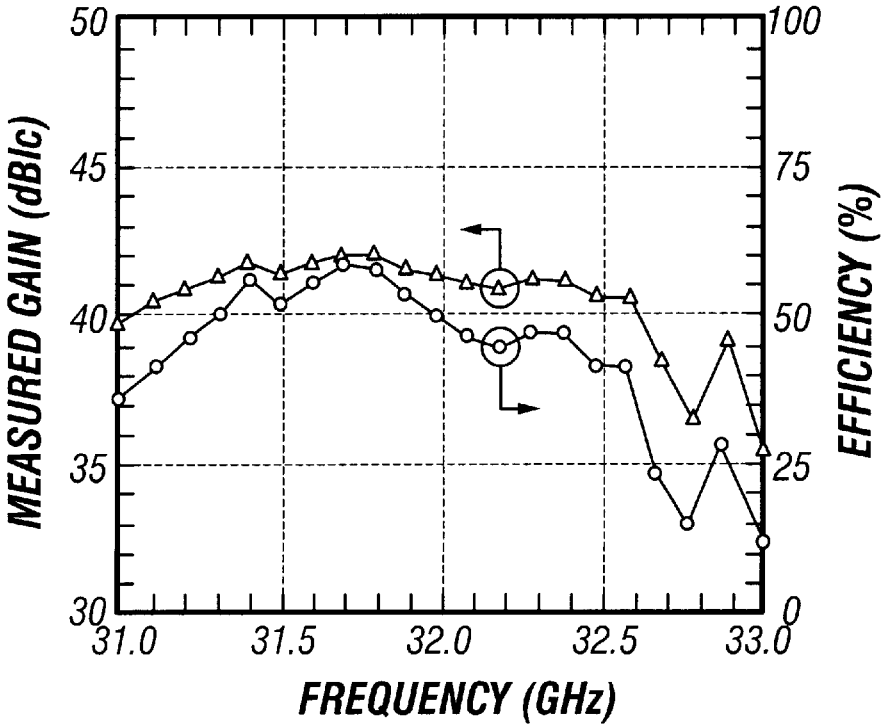
FIG. 8 shows measured bandwidth characteristics of a reflectarray according to the second embodiment, having elements with variable rotation angles.

The bandwidth behavior is shown in FIG. 8, in which the measured gain, as well as the efficiency, are plotted versus the frequency. At the peak, for example, the reflectarray of this second embodiment shows a measured gain of 42.2 dB for an antenna aperture efficiency of 60% at the frequency of 31.7 GHz. From this figure, one may also infer a −1 dB-gain bandwidth of 1.1 GHz (3.5%) and a −3 dB-gain bandwidth of 1.7 GHz (5.4%). Also, FIG. 8 demonstrates a −3 dB beamwidth of 1.2° at the designed center frequency of 32.0 GHz where the measured gain is 41.7 dB for an efficiency of 52%. A wider bandwidth may be obtainable by changing the elements 12, employing a larger f/D ratio, or by using time delay, rather than phase delay, transmission lines.

Almost no oscillatory response is evident in FIG. 8. One reason for this may be that, not only do these elements have identical phase delay lines, but they are also randomly rotated. Thus, it is unlikely that the phase delay lines could resonate with the patches in-and-out of phase in a consistent manner across the frequency band.

In summary, the reflectarray antenna of the second embodiment demonstrates low sidelobes, low cross-polarization, and good bandwidth behavior.

A number of embodiments of the present invention have been described. Nevertheless, it will be understood that various modifications may be made without departing from the spirit and scope of the invention. Accordingly, other embodiments are within the scope of the following claims.

We claim:

1. A beam scanning reflectarray antenna, comprising:

a plurality of high-frequency microstrip reflecting elements, said plurality of reflecting elements spaced from each other at a distance less than one wavelength of an operating frequency of said antenna, at least some of said plurality of reflecting elements being capable of rotation;

a plurality of actuators coupled to respective said at least some of said plurality of reflecting elements to individually command the at least some of said plurality of reflecting elements to rotate at a constant predetermined angular velocity; and a controller coupled to the antenna for determining and locating the at least some of said plurality of reflecting elements and commanding said plurality of actuators corresponding to the determined and located reflecting elements to scan a desired beam of radiation in response to an input.

2. The antenna of claim 1, wherein said plurality of reflecting elements are structured and arranged on a flat plane.

3. The antenna of claim 1, further comprising a plurality of phase delay transmission lines connected to respective ones of said plurality of high-frequency microstrip reflecting elements.

4. The antenna of claim 1, wherein said reflecting elements are metallic.

5. The antenna of claim 1, wherein said reflecting elements are microstrips.

6. The antenna of claim 1, wherein said actuators are micromachined motors.

7. The antenna of claim 1, further comprising a source of electromagnetic radiation directed towards said plurality of reflecting elements, wherein said source includes a circularly polarized horn.

8. The antenna of claim 1, wherein said reflecting elements are crossed resonant dipoles.

9. The antenna of claim 1, wherein said actuators are mechanical microactuators.

10. A method for generating a scanning beam of electromagnetic radiation, comprising:

locating a plurality of high-frequency microstrip reflecting elements in an optical path of the electromagnetic radiation, said plurality of reflecting elements spaced from each other at a distance less than one wavelength of the frequency of the electromagnetic radiation;

associating at least some of said reflecting elements with a corresponding actuactor for rotating at least some of said plurality of elements; and commanding said actuators in response to an input to individually rotate the associated reflecting elements at a constant predetermined angular velocity.

11. The method of claim 10, wherein said plurality of reflecting elements are disposed substantially in a plane, and said controlling electromagnetic radiation includes causing said electromagnetic radiation to be reflected in a predetermined direction relative to said plurality of reflecting elements.

12. The method of claim 10, wherein said controlling electromagnetic radiation includes causing said electromagnetic radiation to be scanned.

13. The method of claim 10, wherein said reflecting elements are microstrips.

14. The method of claim 10, wherein said electromagnetic radiation is circularly polarized, and said controlling electromagnetic radiation includes causing said electromagnetic radiation to be reflected from said plurality of reflecting elements without reversal of the sense of polarization.

15. The method of claim 11, wherein said predetermined direction is normal to the plane of reflecting elements.

16. The method of claim 10, further comprising the step of continuously rotating each reflecting element at a predetermined angular velocity to continuously scan the beam.

17. A scannable beam of circularly polarized light arrangement, comprising:

a source of circularly polarized light;

a plurality of polarized high-frequency microstrip reflecting elements at least partially in the path of said light, at least some of said plurality of elements capable of rotation;

a plurality of actuators coupled to respective said at least some of said plurality of reflecting elements to individually control the amount of rotation; and a controller to command said plurality of actuators in response to an input and to rotate said reflecting elements at a constant predetermined angular velocity to scan the beam.

18. A beam scanning reflectarray antenna, comprising:

a plurality of high-frequency microstrip reflecting elements, said plurality of reflecting elements spaced from each other at a distance less than one wavelength of an operating frequency of said antenna, at least some of said plurality of elements having transmission phase delay lines of variable length;

a plurality of actuators coupled to respective said at least some of said plurality of reflecting elements to individually control the length of the transmission phase delay lines at a constant predetermined rate; and a controller for determining and locating the at least some of said plurality of reflecting elements and commanding said plurality of actuators corresponding to the determined and located reflecting elements to scan a desired beam of radiation in response to an input.

19. The antenna of claima 18, wherein said plurality of reflecting elements are structured and arranged substantially on a flat plane.

20. The antenna of claim 19, wherein said reflecting elements are microstrips.

21. The antenna of claim 18, wherein said actuators are micromachined motors or microactuators.

22. A method for generating a scanning beam of electromagnetic radiation, comprising:

locating a plurality of high-frequency microstrip reflecting elements, said plurality of reflecting elements spaced from each other at a distance less than one wavelength of the frequency of the electromagnetic radiation, at least some of said plurality of elements having variable length transmission phase delay lines, in the optical path of the electromagnetic radiation;

determining which of said reflecting elements need to vary the length of the variable length transmission phase delay lines in order to produce a specified effect; and controlling a plurality of actuators in response to an input, each actuator being coupled to a respective reflecting element to individually control the length of the corresponding variable length transmission phase delay line at a constant predetermined rate and causing the electromagnetic radiation to be scanned.

23. The method of claim 22, wherein said plurality of reflecting elements are disposed in a plane, and said controlling electromagnetic radiation includes causing said electromagnetic radiation to be reflected in a predetermined direction relative to said plurality of reflecting elements.

24. The method of claim 22, wherein said reflecting elements are microstrips.

* * * * *